US006339285B1

(12) United States Patent
Yang

(10) Patent No.: US 6,339,285 B1
(45) Date of Patent: Jan. 15, 2002

(54) CATHODE RAY TUBE WITH AUXILIARY ELECTRODES HAVING A PLURALITY OF SLOTS

(75) Inventor: Hak-cheol Yang, Suwon (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 0 days.

(21) Appl. No.: 09/522,496

(22) Filed: Mar. 9, 2000

(30) Foreign Application Priority Data

Mar. 10, 1999 (KR) ..... 99-7909

(51) Int. Cl.[7] ..... H01J 29/50

(52) U.S. Cl. ..... 313/414; 313/412; 313/426; 315/382

(58) Field of Search ..... 313/414, 444, 313/412, 426, 449; 315/382, 383, 15

(56) References Cited

U.S. PATENT DOCUMENTS 5,864,203 A * 1/1999 Yamane ..... 313/414
6,153,970 A * 11/2000 Chen et al. ..... 313/414
6,172,450 B1 * 1/2001 Natori et al. ..... 313/414

* cited by examiner

*Primary Examiner*—Ashok Patel
*Assistant Examiner*—Ken A Berck
(74) *Attorney, Agent, or Firm*—Lowe Hauptman Gilman & Berner, LLP

(57) ABSTRACT

An electron gun for a color cathode ray tube includes a triode unit, a main lens unit, and first and second auxiliary electrodes. The triode unit includes plural cathodes arrayed in a first direction and first and second electrodes each having corresponding plural electron beam passing holes corresponding to the respective cathodes. The main lens unit finally focuses and accelerates an electron beam and includes a third electrode forming a pre-focus lens with the second electrode. The first auxiliary electrode is coupled to one side surface of the second electrode facing the first electrode. The second auxiliary electrode is coupled to the other side surface of the second electrode facing the third electrode. With this arrangement, a beam spot of uniform size can be formed on the entire surface of a screen.

3 Claims, 6 Drawing Sheets

CATHODE RAY TUBE WITH AUXILIARY ELECTRODES HAVING A PLURALITY OF SLOTS

BACKGROUND OF THE INVENTION

1. Field of the Invention

The present invention relates to an electron gun for a color cathode ray tube (CRT), and more particularly, to an electron gun for a color CRT which can improve the quality of an image by reducing the diameter of an electron beam.

2. Description of the Related Art

In a general electron gun for an in-line type color CRT, the diameter of an electron beam spot formed on a fluorescent surface is affected mainly by a spherical aberration component of a main lens, an object point component of a triode unit disposed in front of the main lens, and a repulsion effect between electrons in a drift space of an electron beam.

There is an optimal intensity and position of a pre-focus lens which can minimize the diameter of a beam spot corresponding to an aberration component of the main lens of an electron gun. Accordingly, when the aberration component of a main lens is determined, a pre-focus lens having a corresponding intensity and position is formed so that the diameter of a beam spot can be minimized.

The intensity and position of the pre-focus lens varies according to the overall specifications of a CRT, for example, the current of an eletron beam, the distance between the fluorescent surface and the electron gun, and conditions of a first grid facing a cathode of the triode unit. In a state in which the specifications of a CRT is determined, the diameter of a beam spot on the fluorescent surface can be minimized by locating an appropriate optimal point of each component of the triode unit corresponding to the aberration component of the main lens.

In an in-line type electron gun, three electron beams proceed along the same plane. In the case of an in-line type electron gun of a large caliber, in which a main lens has a common area through which three electron beams pass in common and a separate area provided in the common area and each electron beam passes separately, since the common area has a shape of horizontally extending corresponding to the plane that electron beams pass, a spherical aberration component of the main lens in a vertical direction appears greater than that in a horizontal direction. Thus, only when the intensity and position of the pre-focus lens of the triode unit in the vertical and horizontal directions are appropriately and independently adjusted, can a quality beam spot be formed on a screen. For a CRT adopting an in-line type electron gun of a self-convergence type, an electron beam is de-focused in a vertical direction due to an irregular magnetic field generated by a deflection yoke when the electron beam is deflected toward a peripheral portion of a screen so that the beam spot is formed to be elongated vertically. Thus, to solve the above problem, a reduction in the height of the electron beam in the vertical direction, that is, extending the electron beam horizontally, is required.

FIGS. 1 and 2 are sectional views schematically showing a conventional electron gun for a color CRT in which an electron beam controlling means for the horizontal extension of an electron beam is provided. In the drawings, the upper side and the lower side of an X—X axis indicate structures in a horizontal direction and a vertical direction, respectively.

Referring to FIG. 1, a first electrode G1 a second electrode G2, and a third electrode G3 are disposed at predetermined intervals in front of a cathode K. Electron beam passing holes G11, G21, and G31 through which an electron beam from the cathode K passes are formed in the respective electrodes G1, G2, and G3. A pre-focus lens is formed between the second electrode G2 and the third electrode G3 due to a difference in the electrical potential therebetween. An auxiliary electrode G23 having a slot G22 of an horizontal extension type for forming a strong electric field in a vertical direction than a horizontal direction formed therein is attached to the side surface of the second electrode G2 facing the third electrode G3. Thus, an electron beam B passing through the pre-focus lens is formed to be extending horizontally by the electric field generated by the slot G22 which is stronger in the vertical direction than in the horizontal direction. The conventional electron beam is for adjusting the intensity of the pre-focus lens, but it has a structure which is not appropriate for adjusting the position thereof.

Referring to FIG. 2, in the conventional electron gun, as shown in FIG. 1, the first electrode G1, the second electrode G2, and the third electrode G3 are disposed at predetermined intervals in front of the cathode K. Electron beam passing holes G11, G21, and G31 through which an electron beam from the cathode K passes are formed in the first, second, and third electrodes G1, G2, and G3, respectively. A pre-focus lens is formed in a space between the second electrode G2 and the third electrode G3 due to a difference in the electrical potential therebetween. An auxiliary electrode G24 having a slot G25 of an horizontal extension type for forming a stronger electric field in a vertical direction than a horizontal direction formed therein is attached to the side surface of the second electrode G2 facing the first electrode G1. Thus, a divergent lens formed between the first electrode G1 and the second electrode G2 is formed to be stronger in the horizontal direction than in the vertical direction by the slot G24 and the pre-focus lens between the second electrode G2 and the third electrode G3 is formed to be strong in the vertical direction and relatively weak in the horizontal direction, which has the same effect as the divergent lens making a change in the distance to the pre-focus lens therefrom. The change in position of the lens induces the horizontal extension of an electron beam. The electron gun having the above structure has a structure more suitable for a change in the position than for a change in intensity of the lens.

Both conventional electron guns as shown in FIGS. 1 and 2 are provided with auxiliary electrodes G23 and G24 to the front or rear side of the second electrode which form a stronger electric field in the vertical direction than the horizontal direction so that the electron beam is extended horizontally by each of the slots G22 and G25 of the auxiliary electrodes G23 and G24. Thus, as indicated above, the electron beam extends horizontally while passing through an irregular magnetic field of the deflection yoke and a beam spot which is close to a regular circle is formed on a screen.

However, the conventional electron guns having only a slot have a disadvantage in that it is difficult to induce changes in both intensity and position of the pre-focus lens corresponding to the spherical aberration of the main lens. For example, in the case of the electron gun shown in FIG. 1, the intensity of the pre-focus lens can be adjusted but the position thereof is difficult to adjust, whereas the electron gun shown in FIG. 2 has a structure more suitable for a change in the position than the intensity of the lens.

SUMMARY OF THE INVENTION

To solve the above problems, it is an objective of the present invention to provide an electron gun for a color CRT having an improved structure in which the intensity and position of the pre-focus lens can be optimized in each of the vertical and horizontal directions.

It is another objective of the present invention to provide an electron gun for a color CRT which can form a uniform beam spot on the entire surface of a screen so that a quality image can be provided.

Accordingly, to achieve the above objective, there is provided an electron gun for a color cathode ray tube comprising: a triode unit including a plurality of cathodes arrayed in a first direction with a predetermined interval, a first electrode having a plurality of electron beam passing holes corresponding to the respective cathodes, and a second electrode having a plurality of electron beam passing holes corresponding to the electron beam passing holes of the first electrode and maintaining a predetermined distance from the first electrode; a main lens unit for finally focusing and accelerating an electron beam including a third electrode having a plurality of electron beam passing holes corresponding to the electron beam passing holes of the second electrode of the triode unit and forming a pre-focus lens with the second electrode; a first auxiliary electrode having a plurality of slots extended in the first direction or in a second direction perpendicular to the first direction which correspond to the electron beam passing holes of the second electrode and coupled to one side surface of the second electrode facing the first electrode; and a second auxiliary electrode having a plurality of slots extended in the first direction or in a second direction perpendicular to the first direction which correspond to the electron beam passing holes of the second electrode and coupled to the other side surface of the second electrode facing the third electrode.

In the present invention, the slots are beam passing holes through which an electron beam passes and form different electric field in the first direction or the second direction perpendicular to the first direction with respect to the electron beam.

BRIEF DESCRIPTION OF THE DRAWINGS

The above objectives and advantages of the present invention will become more apparent by describing in detail a preferred embodiment thereof with reference to the attached drawings in which.

DETAILED DESCRIPTION OF THE INVENTION

Figure 1:
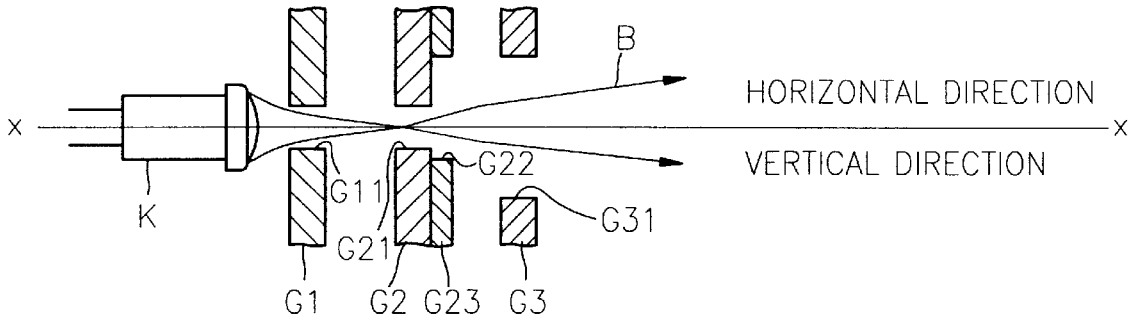
FIG. 1 (PRIOR ART)
FIG. 1 is a sectional view schematically showing an example of a conventional electron gun.
Figure 2:
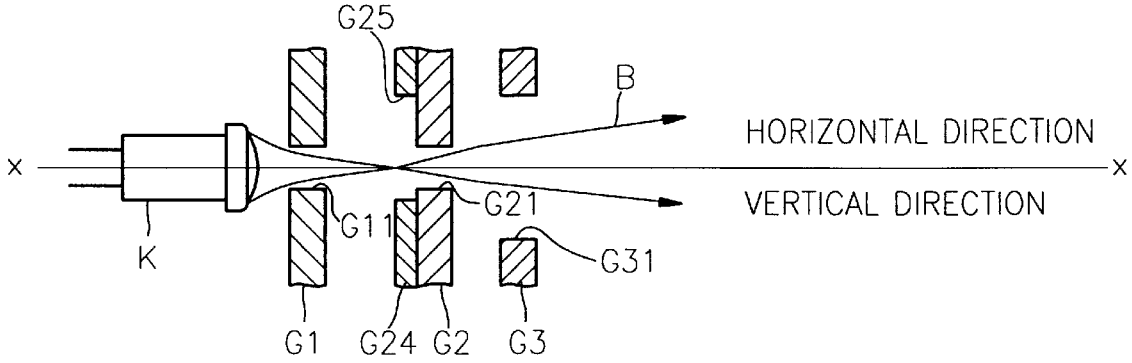
FIG. 2 (PRIOR ART)
FIG. 2 is a sectional view schematically showing another example of a conventional electron gun.
Figure 3:
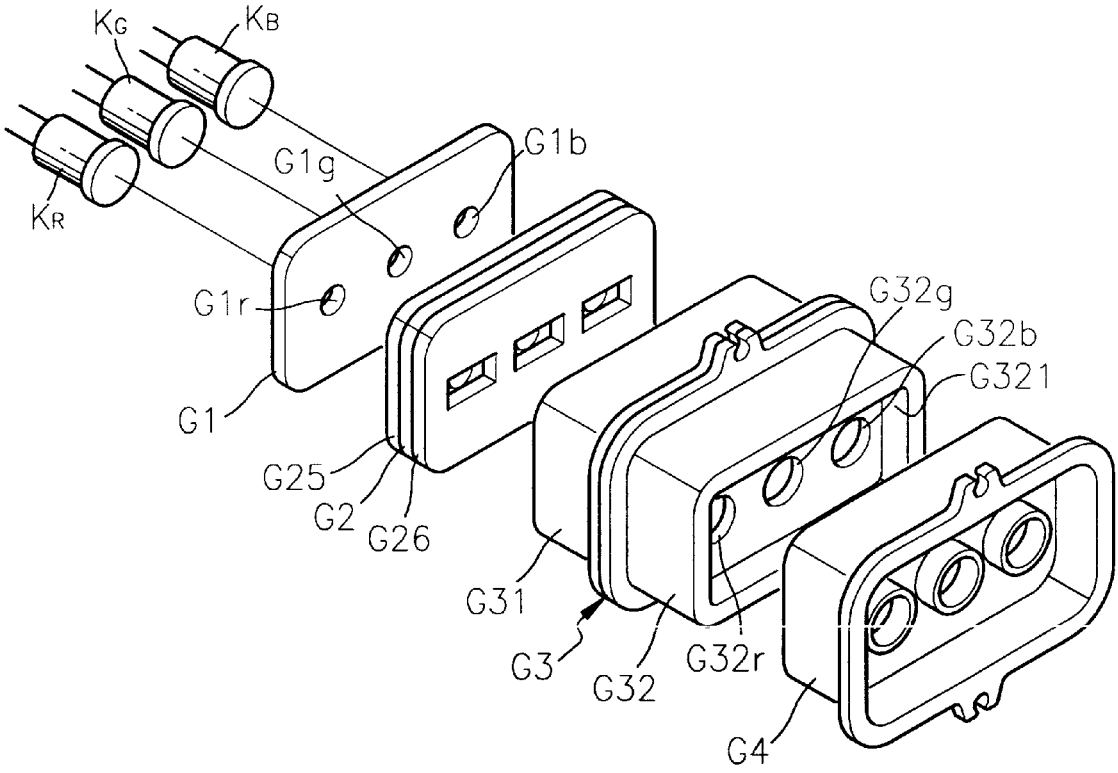
FIG. 3 is a perspective view showing an electron gun for a color CRT according to a preferred embodiment of the present invention.
Figure 4:
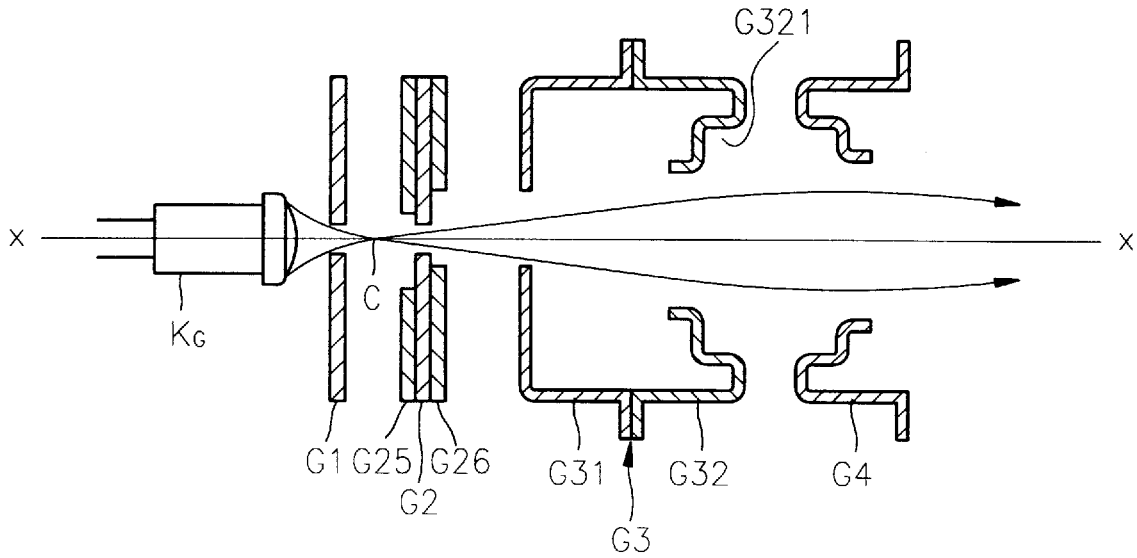
FIG. 4 is a sectional view schematically showing the electron gun shown in FIG. 3.

Referring to FIGS. 3 and 4, three cathodes $K_R$, $K_G$, and $K_B$ disposed at predetermined intervals in a horizontal direction which is a first direction are located a predetermined distance from electron beam passing holes G1*r*, G1*g*, and G1*b* of a first electrode G1. With respect to the cathodes $K_R$, $K_G$, and $K_B$, the first electrode G1, a second electrode G2, a third electrode G3, and a fourth electrode G4 are arranged at predetermined intervals.

The second electrode G2 and the third electrode G3 each are formed of a plurality of members. A first auxiliary electrode G25 and a second auxiliary electrode G26 are attached to both sides of the second electrode G2. The third electrode G3 has a structure in which a first electrode member G31 and a second electrode member G32 of a cup shape are coupled together. The second member G32 of the third electrode G3 and the fourth electrode G4 form an electron lens of a large caliber. An recess portion G321 through which three electron beams pass is formed in a beam passing plane of the second electrode member G32 of the third electrode G3. Separate electron beam passing holes G32*r*, G32*g*, and G32*b* through which each of three electron beams passes separately are formed in the bottom surface of the recess portion G321.

Longitudinally extended beam passing holes G25*r*, G25*g*, and G25*b* and latitudinally extended beam passing holes G26*r*, G26*g*, and G26*b* are formed in the first and second auxiliary electrodes G25 and G26 at both sides of the second electrode G2 as slots through which each of three electron beams pass.

Figure 7:
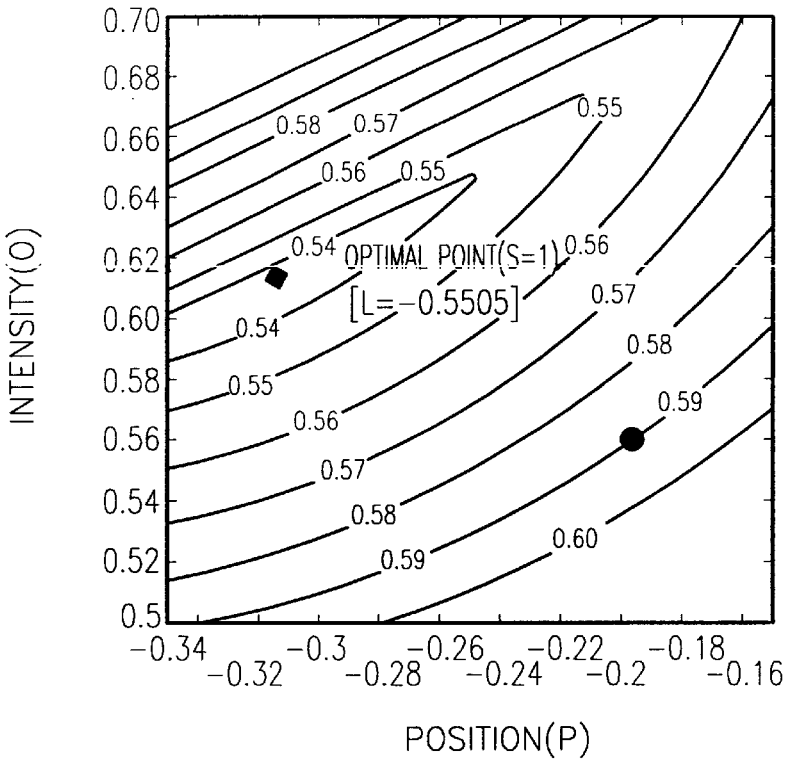
FIG. 7 is a diagram in which the change in an optimal value of the pre-focus lens is indicated by lines when the aberration of the main lens is 1.
Figure 8:
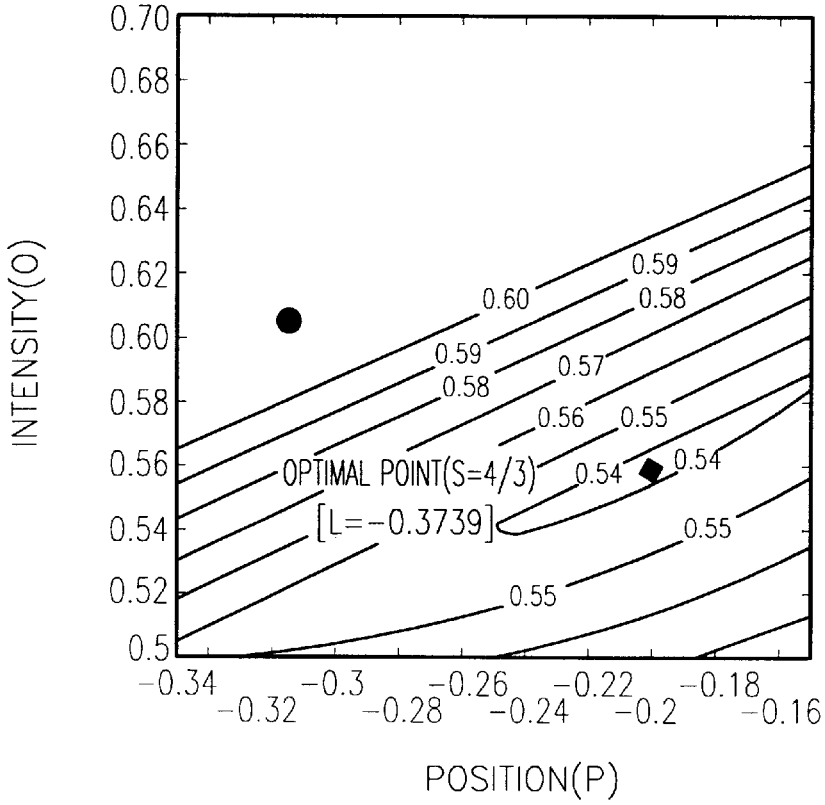
FIG. 8 is a diagram in which the change in an optimal value of the pre-focus lens is indicated by lines when the aberration of the main lens is 4/3.

The above structure applies to an electron gun in which an aberration component of the main lens in a vertical direction is greater than that in the horizontal direction. According to the above structure, the vertical component of an electron beam is controlled by the second auxiliary electrode G26 in a pre-focus lens area and the horizontal component thereof is controlled by the first auxiliary electrode G25 facing the first electrode G1. As the aberration component increases, the optimal distance from a cross over point (C in FIG. 4) to the pre-focus lens disposed between the second electrode G2 and the third electrode G3 increases and the optimal intensity decreases. The aberration component decreases, the optimal distance decreases and the optimal intensity increases. The change in the optimal point can be seen in FIGS. 7 and 8. FIGS. 7 and 8 show the change in diameter of a beam with respect to the intensity O and the position P (the distance from the cross over point to the pre-focus lens) of the pre-focus lens when aberration S is 1 and 4/3, respectively. In FIGS. 7 and 8, the intensity O and the position P of the pre-focus lens are normalized values which are relative values not absolute values. L indicates the distance between the main lens and the pre-focus lens. In the case of FIG. 7 in which aberration S is 1, when the diameter of the beam is the smallest (<0.54), the optimal intensity O of the pre-focus lens is slightly greater than 0.6 and the position of the lens is slightly greater than −0.32. According to FIG. 8 in which aberration S is 4/3, when the diameter of the beam is the smallest (<0.54), the optimal intensity O of the pre-focus lens is slightly smaller than 0.56 and the position of the lens is slightly smaller than −0.2. The result above means that the vertical and horizontal components of the electron beam having different aberration components, respectively, has different optimal values in the vertical and horizontal directions and a triode unit should be formed corresponding thereto. An example according to the above conditions the electron gun shown in FIGS. 3 and 4.

Figure 5:
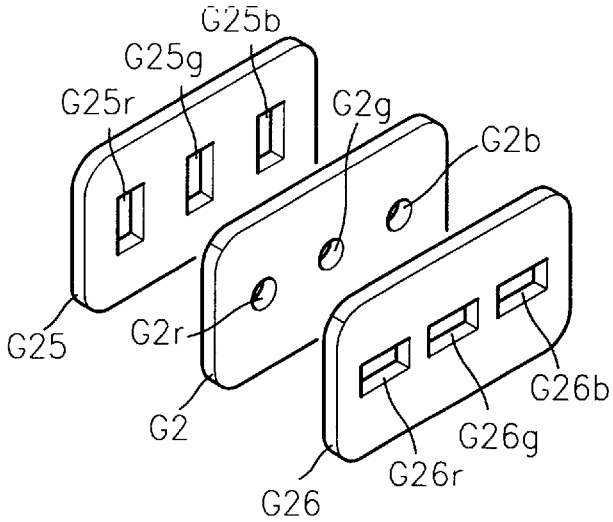
FIG. 5 is an exploded perspective view of the second electrode of the electron gun according to a preferred embodiment of the present invention shown in FIG. 3.
Figure 6:
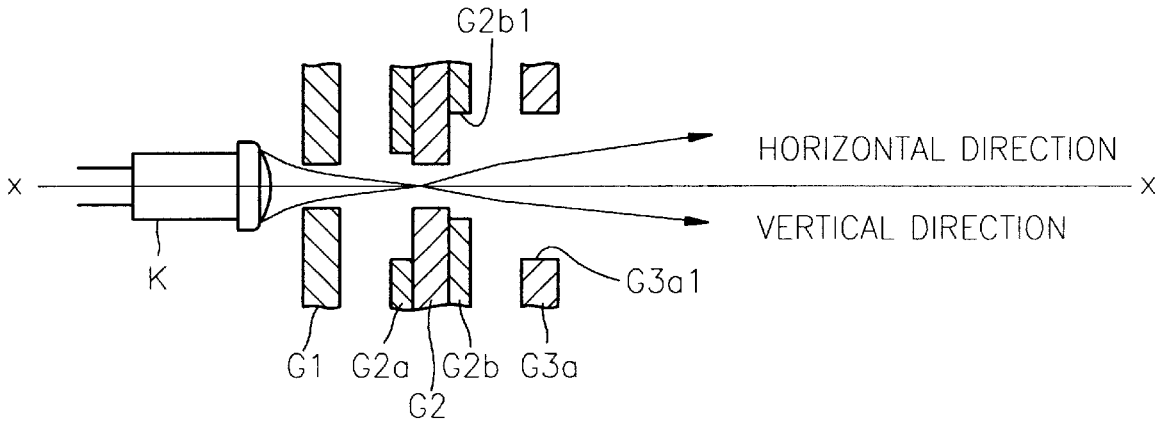
FIG. 6 is a sectional view showing the triode unit of the electron gun according to the present invention shown in FIG. 3.

As mentioned above, in the electron gun shown in FIGS. 3 and 4, aberration of the main lens in the vertical direction is greater than that in the horizontal direction. Thus, the position of the pre-focus lens with respect to the vertical direction should be away from the cross over point P and the intensity of the lens should be decreased. The intensity and position of the lens with respect to the horizontal direction should be opposite to the above. For the above, the first auxiliary electrode G25, in which the longitudinally extended beam passing holes G25*r*, G25*g*, and G25*b* for forming a weaker electric field in the vertical direction than the horizontal direction are formed, is attached to the front side of the second electrode G2 close to the cross over point C, as shown in FIG. 5. The second auxiliary electrode G26 where the latitudinally extended beam passing holes G26*r*, G26*g*, and G26*b* are formed is attached to the rear side of the second electrode G2. Thus, the electron beam is controlled by the first and second auxiliary electrodes G25 and 26 to be located at the optimal position in the vertical and horizontal direction. Also, as shown in FIG. 6, the electron beam proceeds toward the main lens in the horizontally extended state, i.e., the electron beam has a width wider in the horizontal direction than the vertical direction.

When the aberration component of the main lens in the horizontal direction is greater than that in the vertical direction, the beam passing holes of the first auxiliary electrode G25 is made to be wider in the horizontal direction and the beam passing holes of the second auxiliary electrode G26 is made to be wider in the vertical direction.

When the aberration components of the main lens in the vertical direction and horizontal direction are identical, to improve uniformity of the electron beam with respect to the deflection yoke, when the intensity of the pre-focus lens is increased or the position of the pre-focus lens is set to be away from the cross over point regardless of optimization to reduce the occupation radius of the electron beam to the main lens, the object point component increases so that a beam spot which is vertically extended with respect to the screen is formed.

Figure 9:
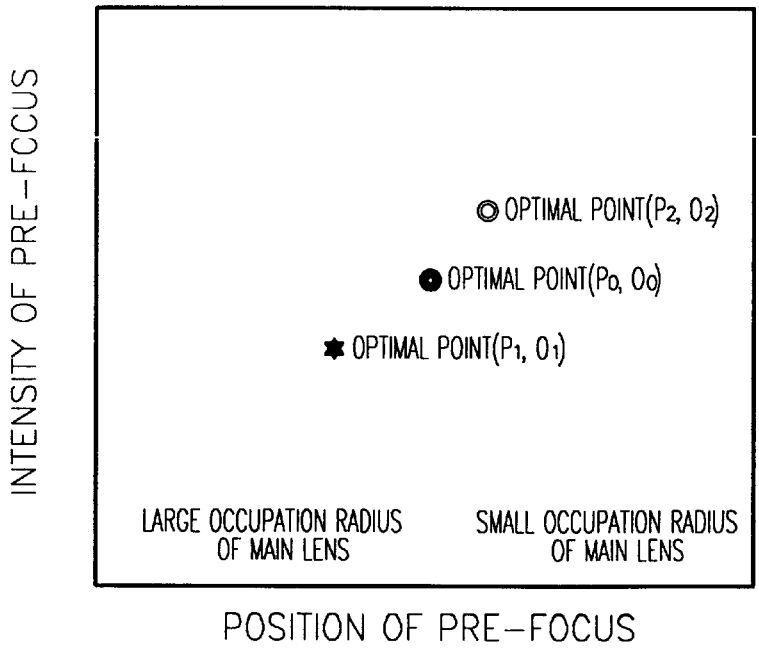
FIG. 9 is a diagram showing the distribution of occupation radius of an electron beam with respect to the main lens when the aberration components of the main lens in the vertical direction and the horizontal direction are identical.
Figure 10:
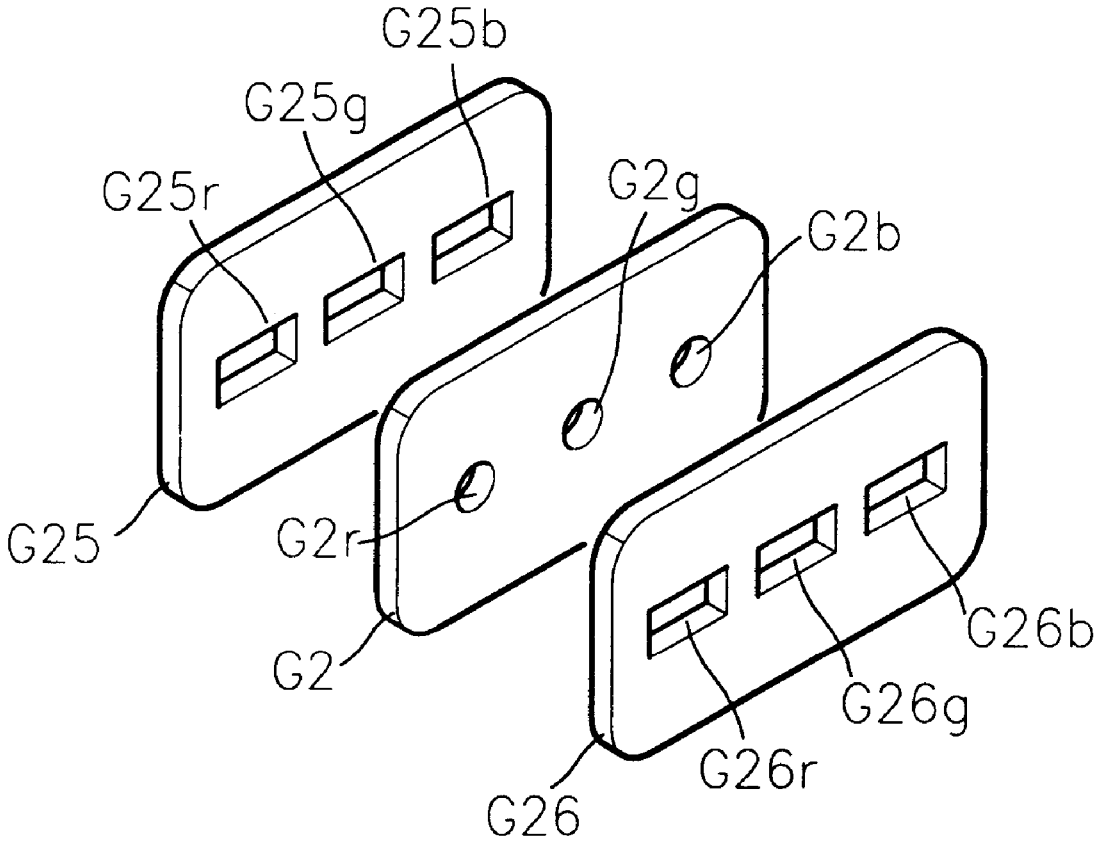
FIG. 10 is an exploded perspective view of the second electrode of the electron gun according to another preferred embodiment of the present invention shown in FIG. 3.

FIG. 9 is a diagram indicating the distribution of the occupation radius of the main lens according to changes in the intensity-position relationship of the pre-focus lens when the aberration components of the main lens in the vertical and horizontal directions are identical. As shown in FIG. 9, the spot of the electron beam formed on a screen is minimized at $P_0$, $O_0$. However, in the case in which the occupation radius of the main lens is small, to reduce the de-focusing effect to the deflection yoke, the optimal intensity and position of the pre-focus change to $P_2$, $O_2$, and when the occupation radius is large, the optimal intensity and position changes to $P_1$, $O_1$. Thus, as shown in FIG. 10, when all beam passing holes formed in the first auxiliary electrode G25 and the second auxiliary electrode G26 are horizontally extended, the occupation radius of the electron beam with respect to the main lens is reduced and the de-focusing is reduced. Also, deterioration of the electron beam formed on the screen can be minimized.

As described above, according to the electron gun for a color CRT according to the present invention, the vertical and horizontal components of an electron beam can be optimized according to the case in which the aberration components in the vertical and horizontal directions are identical or different from each other. Thus, an electron beam spot of a uniform size can be formed on the entire surface of a screen and the size thereof can be reduced 10% compared to the conventional technology Consequently, a uniform beam spot is formed on the screen so that a quality image is possible.

It is noted that the present invention is not limited to the preferred embodiment described above, and it is apparent that variations and modifications by those skilled in the art can be effected within the spirit and scope of the present invention defined in the appended claims.

What is claimed is:

1. An electron gun for a color cathode ray tube comprising:

a triode unit including a plurality of cathodes arrayed in a first direction with a predetermined interval, a first electrode having a plurality of electron beam passing holes corresponding to the respective cathodes, and a second electrode having a plurality of electron beam passing holes corresponding to said electron beam passing holes of said first electrode and maintaining a predetermined distance from said first electrode;

a main lens unit for finally focusing and accelerating an electron beam including a third electrode having a plurality of electron beam passing holes corresponding to said electron beam passing holes of said second electrode of said triode unit and forming a pre-focus lens with said second electrode;

a first auxiliary electrode having a plurality of slots extended in said first direction or in a second direction perpendicular to said first direction which correspond to said electron beam passing holes of said second electrode and coupled to one side surface of said second electrode facing said first electrode; and a second auxiliary electrode having a plurality of slots extended in said first direction or in a second direction perpendicular to said first direction which correspond to said electron beam passing holes of said second electrode and coupled to the other side surface of said second electrode facing said third electrode.

2. The electron gun as claimed in claim 1, wherein each of said beam passing holes of said first auxiliary electrode and said second auxiliary electrode are extended in said first or second direction.

3. The electron gun as claimed in claim 1, wherein said beam passing holes of said first auxiliary electrode and said second auxiliary electrode are extended in said first and second direction or in said second and first direction, respectively, in directions different from each other.

* * * * *